United States Patent [19]

Diehl et al.

[11] Patent Number: 4,470,817

[45] Date of Patent: Sep. 11, 1984

[54] APPARATUS FOR LIMITING THE FIRING FIELD OF A WEAPON, PARTICULARLY AN ARMORED CANNON, DURING PRACTICE FIRING

[75] Inventors: Reiner Diehl; Uwe Paczula, both of Bremen; Manfred Rexin, Langwedel-Daverden; Heinrich-Joachim Siebeneck, Bremen, all of Fed. Rep. of Germany

[73] Assignee: Fried. Krupp Gesellschaft mit beschränkter Haftung, Essen, Fed. Rep. of Germany

[21] Appl. No.: 276,468

[22] Filed: Jun. 23, 1981

[30] Foreign Application Priority Data

Jun. 27, 1980 [DE] Fed. Rep. of Germany ..... 3024247

[51] Int. Cl.[3] ..... F41G 3/00

[52] U.S. Cl. ..... 434/22; 273/313; 42/70 G; 89/134; 89/41 C

[58] Field of Search ..... 434/19–22, 434/16–18; 89/134, 41 C; 42/70 G; 273/310–313

[56] References Cited

U.S. PATENT DOCUMENTS

| | | | |
|---|---|---|---|
| 3,400,393 | 9/1968 | Ash | 89/41 C |
| 3,703,845 | 11/1972 | Griew | 89/134 |
| 3,888,022 | 6/1975 | Pardes et al. | 434/20 |
| 4,137,651 | 2/1979 | Pardes et al. | 273/312 |
| 4,164,165 | 8/1979 | Bean et al. | 89/134 |
| 4,170,077 | 10/1979 | Pardes | 434/22 |

*Primary Examiner*—Richard C. Pinkham
*Assistant Examiner*—Leo Picard
*Attorney, Agent, or Firm*—Spencer & Frank

[57] ABSTRACT

Apparatus for positioning the barrel of a weapon and limiting the firing field of a weapon to a predetermined target area. The apparatus comprises at least one stationary transmitter positioned in or adjacent the firing field and at least one directional receiver rigidly attached to the weapon. A fire unblocking device coupled to the output of the receiver and to the weapon is actuated by the receiver to permit firing of the weapon when a signal is received from the transmitter thereby indicating that the barrel of the weapon is aimed toward the target area.

17 Claims, 10 Drawing Figures

APPARATUS FOR LIMITING THE FIRING FIELD OF A WEAPON, PARTICULARLY AN ARMORED CANNON, DURING PRACTICE FIRING

BACKGROUND OF THE INVENTION

The present invention relates to apparatus for limiting the firing field of a barrel-type tubular weapon to a given target area during practice firing. In particular, it relates to apparatus for limiting the firing field of a mobile weapon, such as an armored cannon, mounted on a battle tank.

Firing field limiting devices are designed to limit the firing angle within which a weapon can be fired with respect to azimuth as well as elevation in order to prevent shots fired by the weapon from striking outside a predetermined target area. Limitation of the firing field to a given target area is necessary because, on the one hand, modern weapons employ long range ammunition and can be fired even when they are moving and, on the other hand, the locations available for practice firing usually extend over a relatively small area.

In the prior art devices of the above-mentioned type for use with the armored cannon of a battle tank, an instructor or supervisor controls the position of the barrel and authorizes firing, the instructor being accommodated either on a seat in the rear portion of the tank turret or at the commander's station. The permissible deviation of the barrel position from the target is marked by demarcation posts on the firing line or on the firing range. With the aid of these demarcation posts, the instructor controls the barrel position in azimuth and elevation, for example from the commander's station via the commander's periscope in the battle tank, and transmits a signal via a key to a fire unblocking device when the barrel is positioned within the given range.

These prior art firing field limiting devices are only marginally reliable because precise control of the position of the weapon is impossible. Further, a sudden change in the position of the barrel after the gun has been unblocked for firing might not be within the natural reaction time of the instructor. If the instructor is seated at the turret, he is subjected to very high stresses, such as firing noise, weather influences, dust, etc., and is particularly endangered when the weapon system malfunctions. If he is seated at the commander's station in the tank, this space is no longer available for training or test runs so that only restricted use can be made of the tank's fire guidance system. Also, if there is a defect in the fire guidance system which prevents the commander's periscope from following the weapon, stray shots could be fired which might hit far outside the target sector and have unpredictable consequences.

In another prior art firing field limiting device for a battle tank, a television camera is disposed in the beam path of an optical target finding device such as a target telescope, the picture from the television camera being transmitted via a radio path to the fire control center. An instructor, located in the fire control center, determines by means of the television picture whether the position of the armored cannon lies within a given range and, if this is the case, radios an unblocking signal to the fire unblocking device in the tank. This system has the same disadvantages as the previously described prior art devices due to the human reaction time of the instructor. Moreover, it is necessary to provide one monitor or instructor for every tank on the firing line as well as a separate radio transmission channel for each tank.

It is an object of the present invention to provide a reliable device for limiting the firing field of a weapon to a given target area during practice firing. It is a further object of the invention to provide a firing field limiting device which operates automatically without the intervention of an instructor or supervisor.

SUMMARY OF THE INVENTION

In accordance with the invention, apparatus is provided for limiting the firing field of a weapon to a predetermined target area. The apparatus comprises at least one stationary transmitter positioned in or near the firing field, and at least one directional receiver rigidly attached to the weapon. A fire release device coupled to the output of the receiver and to the weapon is actuated by the receiver to permit firing of the weapon when a signal is received from the transmitter thereby indicating that the barrel of the weapon is aimed toward the target area.

The firing field limiting apparatus according to the invention performs an automatic function independent of any monitoring personnel and thus avoids the errors resulting from human inadequacies. It has a very short reaction span, detects even sudden pivoting of the weapon or of the moving weapon carrier and considers these before permitting firing. The firing field limiting apparatus is not only very reliable but also has an inherent safety factor in that, if it malfunctions, the fire release device cannot be activated thereby assuring a constant block against firing of the weapon. In contradistinction to the above mentioned prior art firing field limiting devices, the apparatus according to the present invention is fully deployable and operational even at night and under poor visibility conditions, which permits broadening of training situations for the operating personnel of the weapon. The apparatus is just as reliable in conjunction with a stationary or mobile weapon, the travel motion not being restricted in any way. When used in a tank, the tank's fire guidance system is in no way restricted in its operation; rather it can be utilized to its fullest extent to train the operating crew. Moreover, the apparatus is not complicated, easily controlled and adjusted.

When used with an optical transmitter it is possible to exclude interference from radio traffic between the crew of the weapon and the fire control center or between the crews of different weapons. It is also possible to avoid hampering other combat systems such as the fire guidance system of the battle tank by means of the firing field limiting apparatus itself. The use of an infrared transmitter excludes hampering of the gunner by, for example, blinding effects.

By coding the transmitted signal, the generation of a false signal in the receiver and possible activation of the fire release device by an enemy transmission is reliably prevented. This is a further contribution to the reliability and safety of the firing field limiting apparatus of the invention.

DESCRIPTION OF THE PREFERRED EMBODIMENTS

Figure 1:
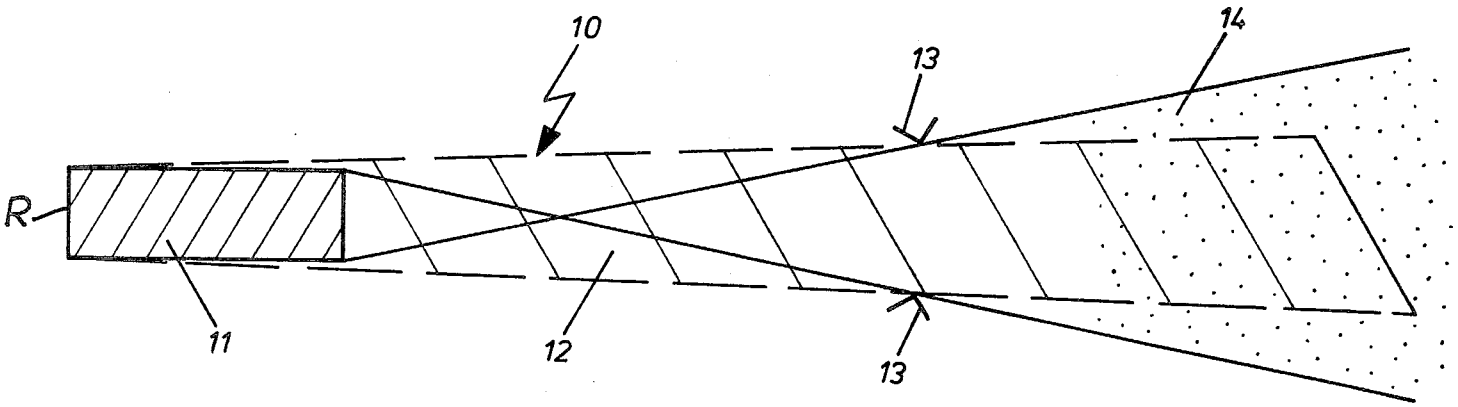
FIG. 1 is a top view of a conventional firing line for a weapon, particularly a battle tank.

Referring to FIG. 1, there is shown a schematic top view of a firing line 10 for one or a plurality of battle tanks which includes a given firing area 11 from which the tank can fire in any desired position. The targets which the tank is to combat are located in a target area 12 adjacent the firing area 11, target area 12 being defined at its sides by demarcation markers 13. In the direction of firing, the target area 12 is followed by a safety zone 14 shown in FIG. 1 as a dotted area.

Figure 2:
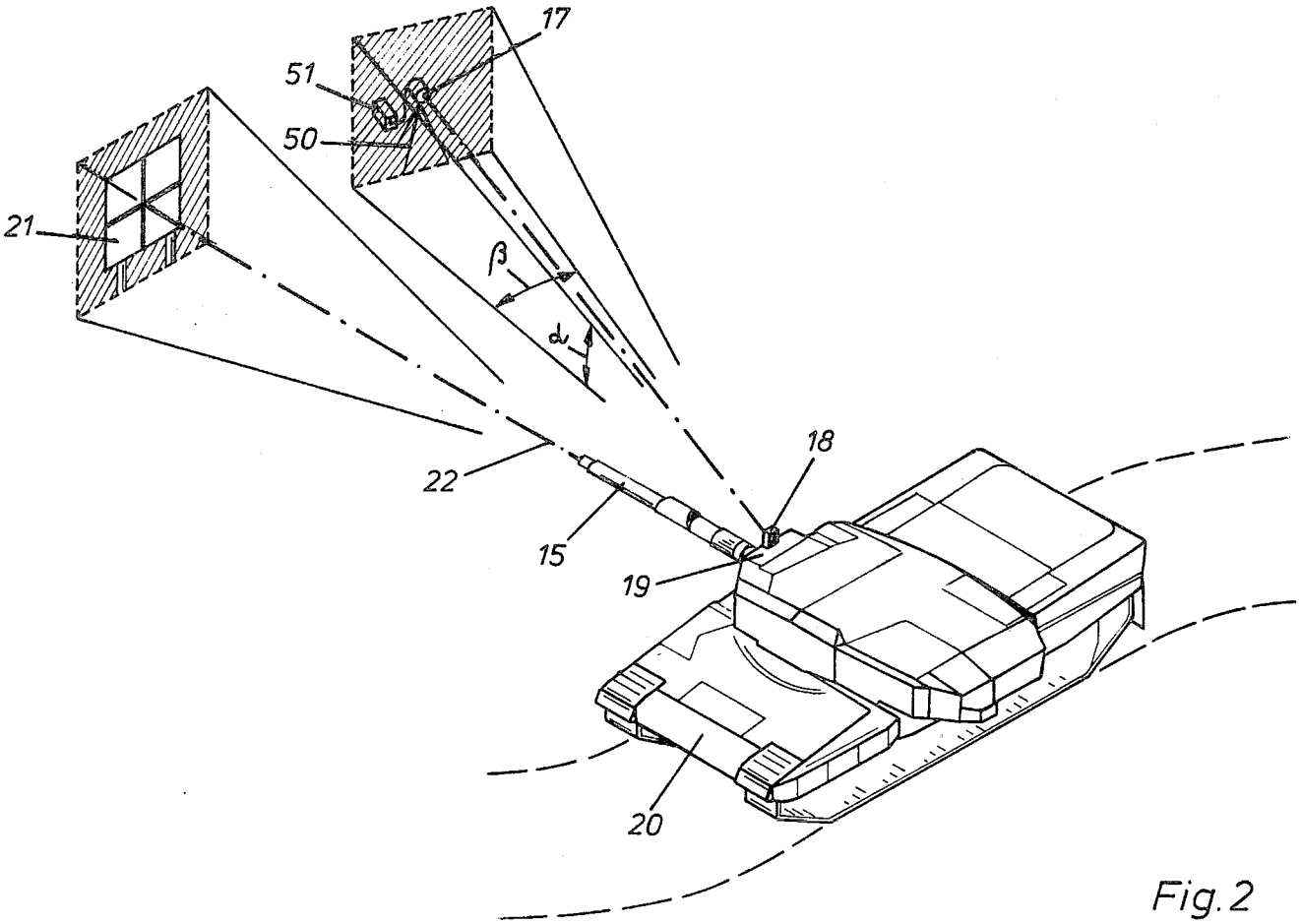
FIG. 2 is a perspective view of a battle tank on the firing line which includes a device for limiting the firing field of its cannon according to a first embodiment of the invention.

The battle tank 20 shown in FIG. 2, which during practice firing on the firing range 11 can be moved at will and fires from its interior, is provided with an armored or onboard cannon 15 having a fire guidance system. A fire release circuit for the cannon 15 (not shown in FIG. 2) is arranged for manual operation by a gunner. A fire unblocking device 16, shown schematically in FIG. 3, normally interrupts the fire release circuit and this prevents the weapon from being fired, the fire release circuit being closed only under conditions explained hereinafter.

For safety reasons, a barrel position control for the onboard cannon 15 is provided during practice firing, firing being permitted by the gunner only if the barrel position control indicates that the onboard cannon 15 is directed toward any target which lies within the target area 12. This function is provided by a firing field limiting device which comprises the unblocking device 16, at least one stationary transmitter 17 and at least one receiver 18, the receiver or receivers 18 having directional reception patterns or characteristics and being rigidly connected to the onboard cannon 15. The receiver is preferably attached to the weapon aperture 19 of the cannon thereby permitting its movements to be followed. As will be explained hereinafter, the receiver or receivers 18 are connected to the fire unblocking device 16 in such a manner that a received signal activates the fire unblocking device permitting the weapon to be fired.

Referring to FIGS. 1–4, the firing field limiting device may be used advantageously when the battle tank 20 is to fire out of the firing area 11 at a stationary target in the target area 12, for example, at the target board 21 shown in FIG. 2. The transmitter 17 is located preferably at a slightly lateral distance (about 25 meters) from the stationary target board 21 in the target area 12, the transmitter 17 being disposed at approximately the same distance from the firing area 11 as the target board 21 and at approximately the same height above ground as the target plate.

A single receiver 18 is provided at the weapon aperture 19 of the onboard cannon 15. The receiver 18, which is oriented toward the transmitter 17, has a directional reception pattern with an aperture angle ($\alpha$ in elevation and $\beta$ in azimuth) corresponding to the spatial angle for the permissible deviation of the bore axis 22 of the onboard cannon 15 from the bore axis 22 when the onboard weapon is aligned directly with the target.

Figure 3:
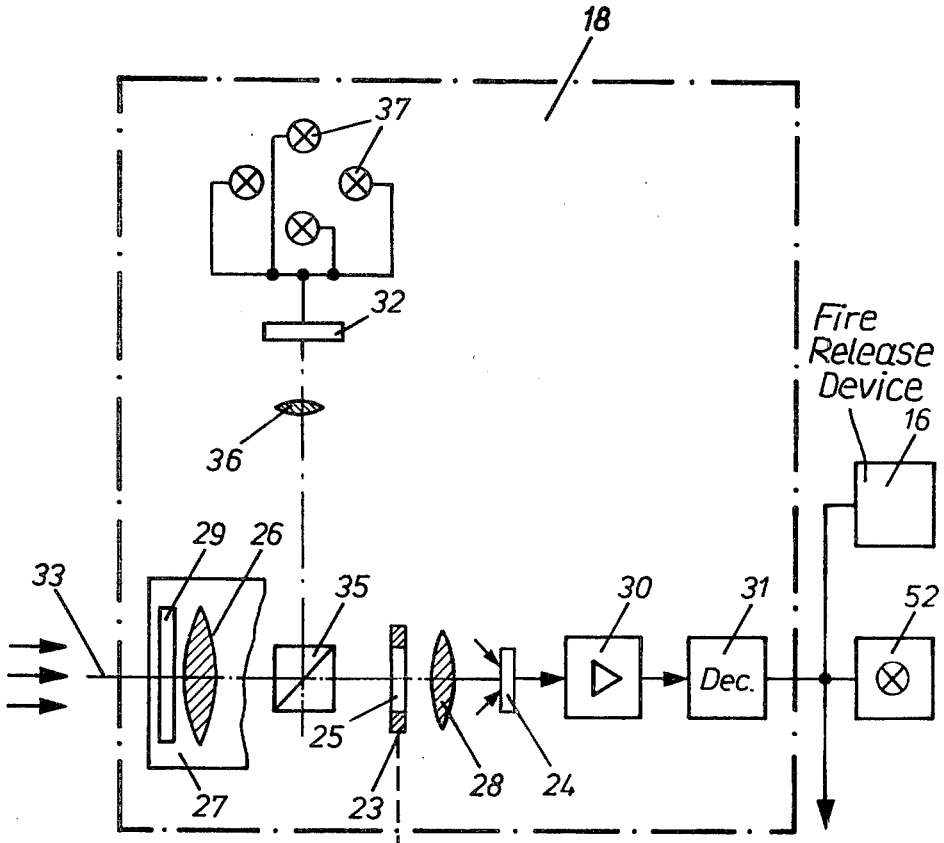
FIG. 3 is a block circuit diagram of the receiver for the firing field limiting device of FIG. 2 schematically illustrating the optical system.
Figure 3A:
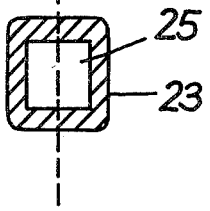
FIG. 3A is a cross sectional view of an optical mask used in the receiver of FIG. 3.

The transmitter 17 is an optical transmitter preferably generating radiation in the infrared range, and the aperture angle of the directional reception characteristic of the receiver 18 is determined by an optical aperture mask 23 (FIGS. 3 and 3A). Mask 23 is disposed ahead of a light-sensitive decoder 24 and has an aperture 25 which determines the elevation and azimuth of the aperture angle of the receiver characteristic.

In the embodiment illustrated in FIGS. 3 and 3A, the aperture 25 has an approximately square shape. An objective lens 26 enclosed in a pitot tube 27 is provided in front of the aperture opening 25, the aperture mask 23 being arranged so that it lies in the image plane of the objective 26. The pitot tube generates an air stream to prevent the deposit of dust and dirt on the objective lens 26.

In order to assure a uniform light distribution on the light-sensitive detector 24 and improve the receiving capability of the receiver, a field lens 28 is provided behind the mask 23. A spectral filter 29 is placed in front of the objective 26 to prevent extraneous light from interfering with reception by the receiver 18.

The light-sensitive detector 24, which has a characteristic that depends on the light spectrum emitted by the transmitter 17, is connected to an amplifier 30 whose output is connected to the input of a decoder 31. The decoder 31 is required only if the transmitted signals are coded to decrease the effect of extraneous light interference on the firing field limiting device. The output of the decoder 31 is connected directly to the fire unblocking device 16.

The receiver 18 is provided with a position detecting diode 32 which detects coincidence and/or deviation of the transmitter image in the receiver 18 with respect to the optical axis 33 of the receiver. For this purpose a beam divider 35 is positioned between the objective 26 and the mask 23 so as to divide the incoming light beam into two orthogonal parts, and transmit one part through an enlarging objective 36 to the diode 32. The position detecting diode 32 is connected to a total of four display lamps 37 which indicate if there is a deviation of the transmitter image to the right, left, above or below the optical axis 33 of the receiver 18. If all four display lamps 37 emit light, the adjustment is correct; that is, the optical axis 33 of the receiver 18 exactly coincides with a line connecting the receiver 18 and transmitter 17. The position detecting diode permits simple and rapid adjustment of the firing field limiting apparatus by aligning a line connecting the transmitter and receiver with the receiver axis.

In order to adjust the receiver 18 to the transmitter 17, the onboard cannon 15 is aligned exactly with the target board 21 by means of a target telescope provided in the tank 20. The receiver 18 is then moved until all four display lamps 37 light up indicating that the receiver 18 is aligned exactly with the transmitter 17. The receiver 18 is then fixed in this position so that it can no longer change its angular position relative to the onboard cannon 15. During this adjustment, the tank 20 must be situated at the rear transverse demarcation line R of the firing area 11 remote from the target area 12; that is, it must be at the farthest possible distance from the target.

Figure 4:
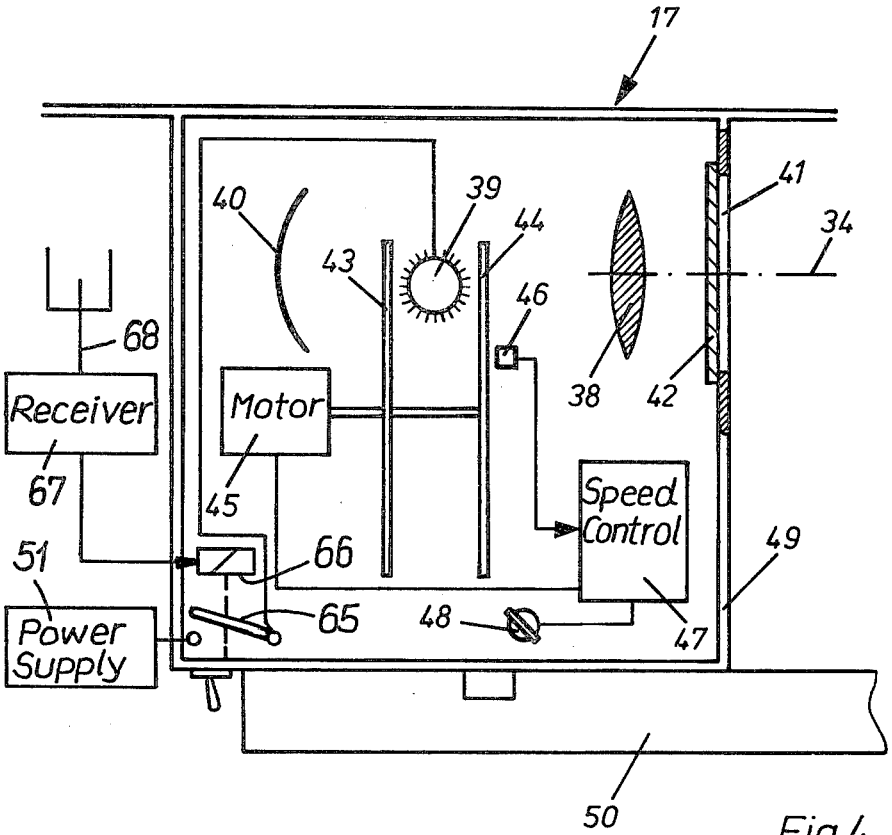
FIG. 4 shows a longitudinal sectional view of a transmitter for the firing field limiting device of FIG. 2.

The configuration of the optical transmitter 17 is shown schematically in FIG. 4. An objective lens 38, a light source 39 and a reflector 40 are arranged one behind the other along the optical axis 34 of transmitter 17, a light transmission window 41 covered by a filter 42 through which infrared light can pass receiving light from the objective lens 38. This configuration provides a relatively long transmitting range on the order of 2000 meters with a relatively low power light source of about 400 watts.

The transmitted signals are coded by simple light-/dark keying. For this purpose, rotating slotted discs 43 and 44 are disposed in the beam paths on the upstream and downstream sides of the light source 39, both discs being driven in synchronism by an electric motor 45. The speed of rotation of the two slotted discs 43 and 44 is detected by a photodiode 46 and is regulated to maintain a constant value by a conventional electronic speed control system 47. A rotary switch 48 is used to set the speed of the slotted discs 43 and 44 at different constant values so as to change the signal coding.

The transmitter 17 is accomodated in a housing 49 and mounted on a mast 50, the housing 49 being aligned in such a manner that the marginal beams of the radiation pattern of the transmitter substantially include the demarcation lines of the firing area 11. By means of an electrical line or radio transmission, the power supply 51 (FIGS. 2 and 4) for the light source 39 can be switched on or off from a location remote from the transmitter such as the firing range fire control center. For this purpose, a switch contact 65 of a relay 66 is arranged between the power supply 51 and the light source 39. The relay 66 is operated by a radio receiver 67 which receives an on or off signal via an antenna 68.

The operation of the firing field limiting device of FIGS. 2–4 will now be described. An image of the light exit opening of the transmitter 17 is formed on the light-sensitive detector 24 after passing through the objective 26 of receiver 18 only if the transmitter 17 is located in an area relative to the receiver optical axis 33 which is defined by the aperture 25. This area is illustrated in FIG. 2 with respect to elevation by the angle $\alpha$ and with respect to azimuth by the angle $\beta$. The above-described alignment of the receiver 18 with the transmitter 17 corresponds to the case in which the bore axis 22 of the barrel of the onboard cannon 15 deviates by no more than the angle $\alpha$ in elevation and the angle $\beta$ in azimuth from exact alignment with the target.

As long as the light-sensitive detector 24 receives light, it generates a signal which is amplified and transmitted through the decoder 31 to provide an activation signal for the fire unblocking device 16. When device 16 is activated, the commander or the gunner of the battle tank is permitted by the system to fire a shot. At the same time, the signal emitted by the light-sensitive detector 24 is transmitted as a control signal to a fire block display 52 which is extinguished thereby indicating to observers that the position of the gun barrel is being maintained within a safe angular region.

As soon as the bore axis 22 of the barrel of the onboard cannon 15 deviates by more than the angle $\alpha$ or the angle $\beta$ from its exact position of alignment with the target, the light-sensitive detector 24 of receiver 18 no longer generates a signal. Consequently, the fire unblocking device 16 is not activated and firing is blocked automatically.

The firing field limiting device according to the above-described embodiment functions properly when a shot is fired from any desired location of the battle tank 20 within the firing area 11 onto a target at a fixed position within target area 12, the shot being fired with the battle tank 20 being either stationary or moving. However, if it is desired to fire a shot over the entire width of the target area 12, either at a moving target or at various targets arranged offset with respect to one another over the width of the firing line, the firing field limiting apparatus described thus far is not satisfactory.

In such a case, an apparatus according to another embodiment of the invention is used which employs two transmitters 117 and 117' and two receivers 118 and 118'.

Figure 5:
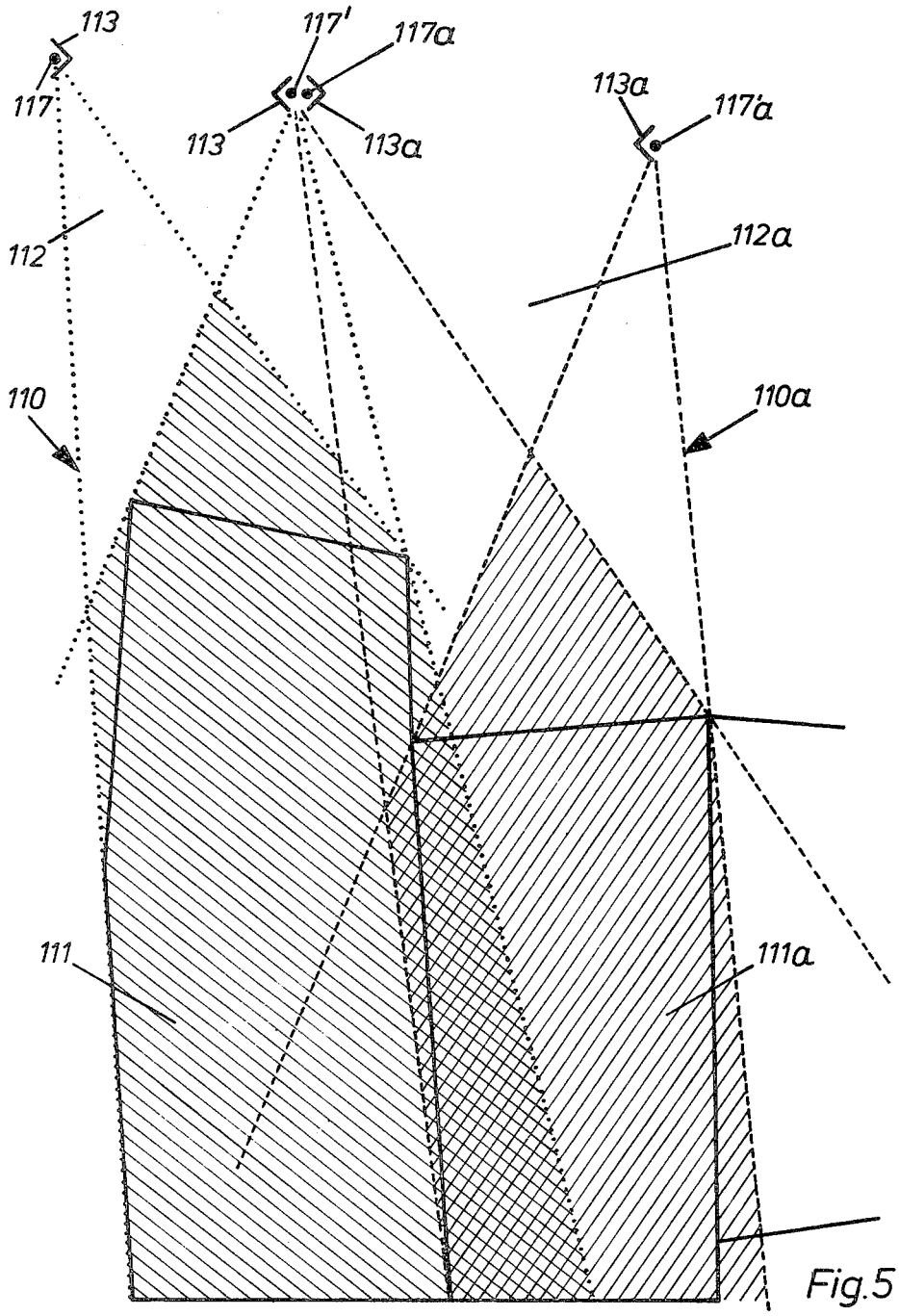
FIG. 5 depicts a top view of a firing range with two approximately parallel firing lines and transmitters in a firing field limiting device according to a second embodiment of the invention.

FIG. 5 shows a firing location defined by two essentially parallel firing lines 110 and **110*a*. The firing lines 110 and 110*a* include firing areas 111 and 111*a* which are bounded by the solid black lines. The transmitters 117 and 117' for the firing line 110 and the transmitters 117*a* and 117'*a* for the firing line 110*a* are located at both sides of the target areas 112 and 112*a*, respectively, and are mounted on demarcation markers 113 and 113*a*, respectively, which define the sides of the target areas 112 and 112*a* extending approximately in with direction of firing. The transmitters 117, 117', 117*a*, 117'*a* are shown in FIG. 5 by dots. Each transmitter 117, 117', 117*a*, 117'*a* has a directional characteristic or directional radiation pattern and is aligned in such a manner that the marginal beams of the characteristic substantially include the demarcation lines (solid black lines in FIG. 5) of the corresponding firing areas 111, 111*a*. In FIG. 5 the marginal beams of the characteristics of the transmitters 117 and 117' are shown in dotted lines and the marginal beams of the characteristics of the transmitters 117*a* and 117'*a*** are shown in dashed lines.

The shaded zones in FIG. 5 are areas which are covered by characteristics of both transmitters 117 and 117' for the firing line 110 and transmitters **117*a* and 117'*a* for the firing line 110*a*. In these areas one of the two firing field limiting devices for each firing line 110, 110*a* is effective. These areas respectively limit a predetermined firing range for each firing line 110, 110*a*, within which the battle tank 20** is freely movable and permitted to fire.

As shown in FIG. 5, there is a field in which the shaded zones overlap and in which both firing field limiting devices are effective. To prevent improper operation in this region, the signals emitted by transmitters 117 and 117' are coded differently from the signals emitted by transmitters **117*a* and 117'*a***.

Figures 6, 6A, 6B:
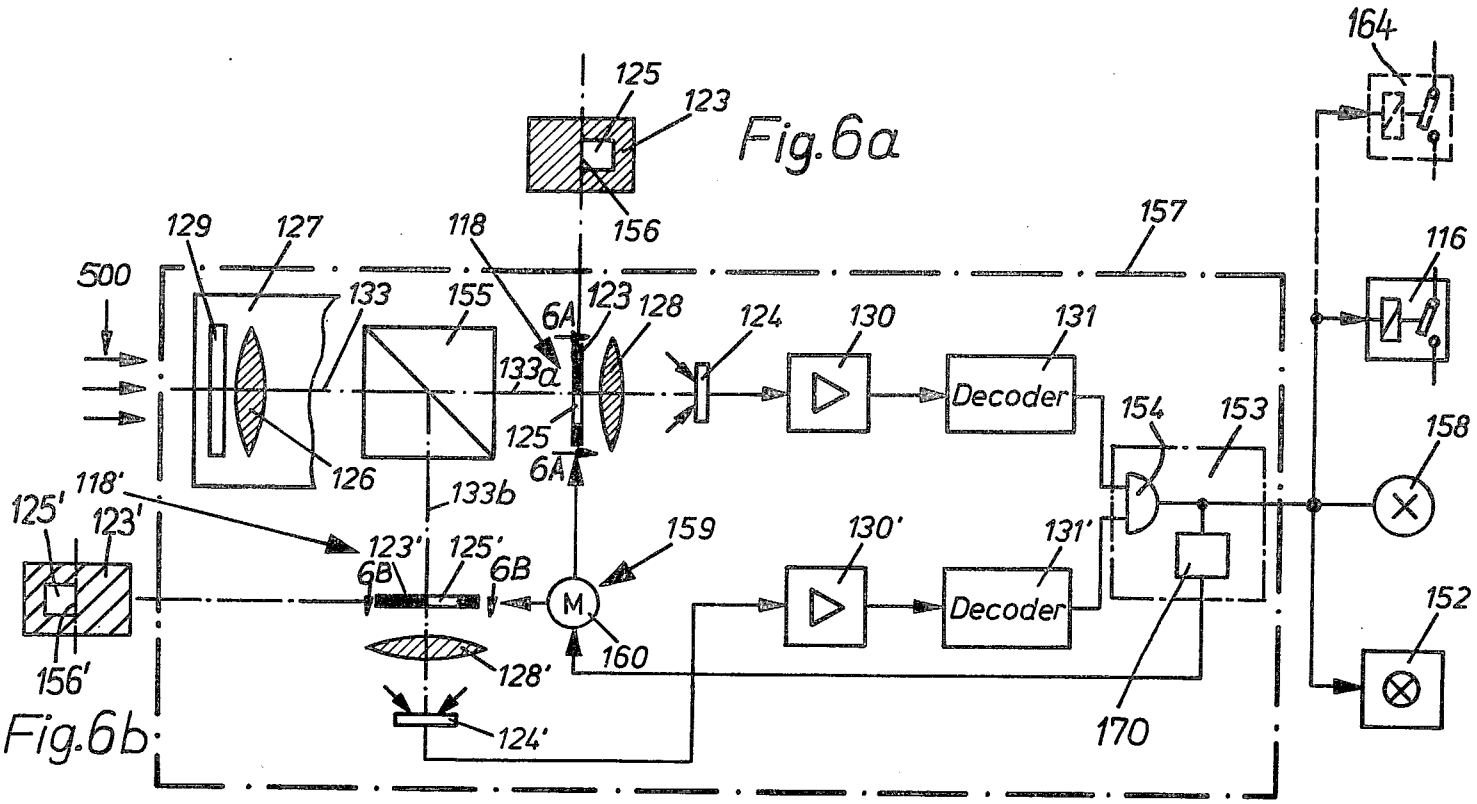
FIG. 6 is a block circuit diagram schematically illustrating the receivers of the firing field limiting device according to the second embodiment of the invention.
FIGS. 6A and 6B are cross-sectional views of optical masks used in the receivers of FIG. 6.

Referring to FIG. 6, two receivers 118 and 118' are provided within a housing 157. Receiver 118 comprises an optical mask 123 having an aperture 125, a field lens 128 and a light-sensitive detector 124 positioned along an axis **133*a*. Similarly, the receiver 118' comprises an optical mask 123' having an aperture 125', a field lens 128' and a light-sensitive detector 124' positioned along an axis 133*b*. The outputs of detectors 124 and 124' are coupled to decoders 131 and 131' through amplifiers 130 and 130'**, respectively.

Decoders 131 and 131' are bandfilters having resonant frequencies tuned to the output frequencies of transmitters 117, 117' and 117*a*, 117'*a*, respectively. The outputs of the decoders 131 and 131' are coupled to an electronic evaluation system 153 which includes a logic AND gate 154, the output of which is connected to the fire unblocking display 158. Fire unblocking device 116 is a relay having switch contacts in the fire release circuit manually operated by the gunner. The fire unclocking display 158 is a lamp which is switched on by the output signal of the logic AND gate 154, and the fire block display 152 is a lamp which is switched off by the output signal of the logic AND gate 154.

The receivers 118 and 118' receive light indicated by arrows 500 which is transmitted along an optical axis 133 through a spectral filter 129 and an objective lens 126. The objective 126 and filter 129 are located within a pitot tube 127, as shown in section in FIG. 6. A beam divider 155 receives light from the objective 126 positioned on the optical axis 133 and transmits a first beam along the axis 133*a*, which coincides with optical axis 123, to the lens 128 and a second beam at right angles to the optical axis 133 along an axis 133*b* to lens 128'. Consequently, the two image planes associated with the objective 126 are offset in space with respect to one another by 90° and one of the two masks 123 and 123' is disposed in each of the image planes.

As shown in FIG. 6A, the mask 123 has a vertical demarcation edge 156 which is orthogonal to the axis 133*a*, the aperture 125 extending in FIG. 6 to the right of axis 133*a* viewed in the direction of light transmission. Similarly, as shown in FIG. 6B, the mask 123' has a vertical demarcation edge 156' which is orthogonal to the axis 133*b*, the aperture 125' extending to the left of axis 133*b* in the direction of light transmission. Accordingly, the angular range of each of the two receivers 118 and 118' extends in azimuth from a point defined by the outer edges of the apertures 125 and 125' respectively and the optical axis 133.

By providing a common optical system for the two receivers, their manufacturing costs are substantially reduced. Also, by providing apertured masks arranged with alternating symmetry with the optical axis, the two desired directional characteristics for the receivers can be realized in a simple manner.

The common height of the apertures 125, 125' is determined by the permissible elevation angle of the onboard cannon 15 with respect to the horizontal plane. This is determined by the distance of the target area 112 from the firing area 111 and by the extent of the safety area adjacent the target area. The aperture height is selected to assure that the opening angle of the receiving patterns of both receivers 118 and 118' are the same in elevation as the permissible elevation angle of the bore axis 22 of the onboard cannon 15 with respect to the horizontal plane. The width of the aperture, that is, its horizontal dimension, is not critical but must be large enough to permit the opening angle of the receiving radiation patterns of the two receivers 118 and 118' to cover the entire width of the target area 112 when the battle tank 20 is disposed at the forward border of the firing area 111 nearest the target area and the onboard cannon 15 is directed toward one of the transmitters 117 and 117'. The optical axis 133 is oriented parallel to the bore axis 22 of the onboard cannon 15 and lies preferably in the same common vertical plane, axes 133*a* and 133*b* also being effectively parallel to the bore axis 22 and in the same vertical plane. Consequently, the directional characteristics of the receivers 118 and 118' are such that the adjacent marginal beams of both characteristics lie in the vertical plane which passes through the bore axis 22.

To permit alignment of the optical axis 133 and the bore axis 22, the receivers are adjustably accommodated in the common housing 157 which is fastened at the weapon aperture 19 of the onboard cannon 15. The onboard cannon 15 is directed precisely toward one of the two transmitters 117 and 117' by means of a sighting device provided on the battle tank 20. The housing 157 is then pivoted until the fire unblocking display 158, which is controlled by the output signal of the AND gate 154, either lights up or is extinguished. Pivoting of the housing 157 toward the outside, i.e. toward the lateral limits of the target area 112 causes the fire unblocking display 158 to just extinguish, and pivoting of the housing 157 from the lateral limits of the targets area toward the interior causes it to light up. With this type of adjustment, the battle tank 20 can take on any desired position within the firing area 111.

The configuration of the two optical transmitters 117 and 117' is identical to the optical transmitter 17 described in connection with FIG. 4. The transmitters 117 and 117' associated with the same firing line 110 employ the same codes in their transmitted signals and are aligned so that the directional radiation pattern determined by the aperture angle of the respective transmitter objective covers the firing area 111. It is important that the transmitter power output be sufficient to provide adequate signal strength.

The firing field limiting device according to the second embodiment operates as follows:

Since the signals at the output of the two receivers 118 and 118' are coupled to the AND gate 154, the fire unblocking device 116 receives an activation signal only if both receivers detect transmitted signals. This occurs only if the optical axis 133, and therefore the bore axis 22 of the onboard cannon 15 which is axially parallel thereto when the receivers 118 and 118' are aligned, passes between the transmitters 117 and 117' which are disposed on the demarcation markers 113 of the target area 112. When the onboard cannon 15 is directed toward one of the two transmitters 117 or 117', one of the two receivers 118 or 118', due to its directional characteristic, is not able to receive the other transmitter. Thus, only one received signal reaches the AND gate 154 and the fire unblocking device 116 is not activated. The onboard cannon 15 remains blocked until it is pivoted slightly away from the transmitter 117 or 117' toward the center of the target area.

The permissible elevation angle of the onboard cannon 15 with respect to the horizontal plane is given by the vertical dimension of the two apertures 125 and 125'. Here again, the housing 157 enclosing the two receivers 118 and 118' must first be aligned with the weapon aperture 19 by first setting the onboard cannon 15 to an elevation angle corresponding to the permissible elevation angle. The housing 157 is then adjusted upwardly in the vertical direction until the fire unblocking display 158 just extinguishes, or is adjusted downwardly until the fire unblocking display 158 just lights up.

Under some circumstances, the azimuth component of the aperture angle of the receiving characteristics is relatively large and the tank 20 tilts causing the weapon aperture 19 and the two optical masks 123 and 123' to be slanted with respect to the horizontal. This causes the unblocking range of the firing field limiting device to be restricted in elevation considerably more than indicated by the permissible elevation angle of the onboard cannon 15; that is, by the height of the aperture openings 125 and 125'. Consequently, no firing unblocking signal is given although the onboard cannon 15 has assumed a position at which a fired shot must hit within the target area 112.

In order to overcome this drawback, mask 123 is mounted so that it may be pivoted about its axis 133*a* and mask 123' is mounted so that it may be pivoted about its axis 113*b*. Upon tilting of the battle tank 20 or weapon aperture 19, a mask pivot device 159 synchronously pivots the two aperture masks 123 and 123' about their axes 133*a*, 133*b* so that they are again aligned approximately horizontally. For this purpose, the pivot drive 159 is provided with a stepping motor 160 controlled by the electronic evaluation system 153.

The electronic evaluation system 153 includes a start/stop oscillator 170 connected to the stepping motor 160. Each oscillator pulse drives the stepping motor one step in the same direction of rotation. The stepping motor 160 includes a limit switch (not shown) for reversing the direction of its rotation after a fixed number of steps in the same direction. If at least one received signal is missing, the motor initially pivots both masks 123 and 123' in steps about their axes within a given pivot range in both pivoting directions to determine whether, within this pivot range, a transmitted signal can be detected. As soon as each receiver 118, 118' receives a signal, the output signal of the logic AND gate 154 stops the oscillator 170 and the stepping motor 160 is rendered inactive. The mask 123 and 123' are aligned horizontally. Also, the fire block display 152, which is connected to the electronic evaluation system 153, indicates a fire block to an observer.

With a plurality of target areas 112 arranged next to one another, as shown in FIG. 5, the transmitters 117 and 117', which are associated with the transmitted signals from the various target areas 112, are coded differently. This prevents firing field limiting devices effective in the various target areas 112 from influencing or interfering with one another despite unavoidable overlapping of the directional characteristics of the transmitters 117 and 117'.

Figure 7:
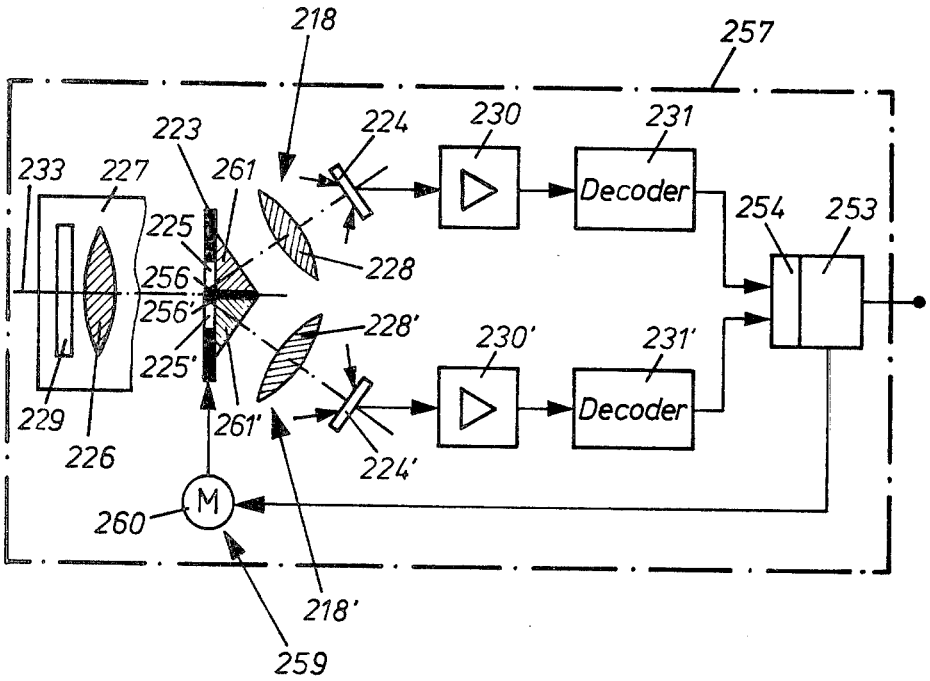
FIGS. 7 and 8 are block circuit diagrams of modified embodiments of the receivers of FIG. 6.
Figure 8:
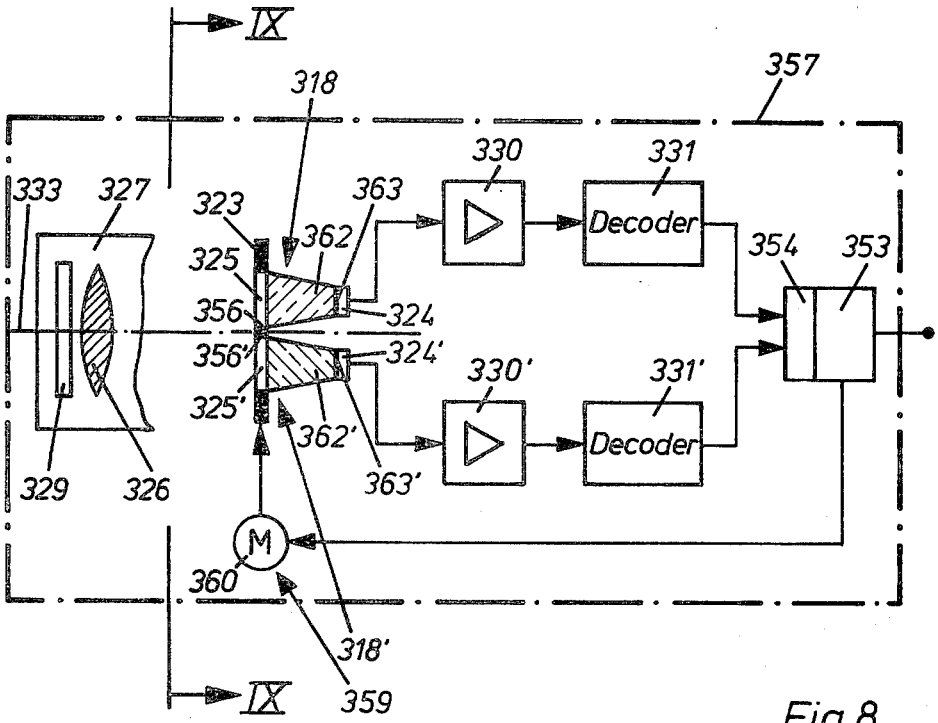

FIGS. 7 and 8 show block circuit diagrams of modifications of the receivers of FIG. 6. Since these receivers are essentially similar, the same components bear corresponding reference numerals which are in the 200 series in FIG. 7 and the 300 series in FIG. 8.

Referring to FIG. 7, receivers 218 and 218', which are mounted within a common housing 257, have a common objective 226 which receives light through a spectral filter 229. In the image plane of the objective 226, there is disposed a mask 223 which is common to both receivers and has two separate openings 225 and 225', the aperture being arranged symmetrically with respect to the optical axis 233 of the objective 226. The optical axis 233 divides to form the two axes of the receivers 218 and 218', the openings 225 and 225' being arranged in alternating symmetry with respect to the optical axis 233. The facing vertical delimiting edges 256 and 256' of the openings 225 and 225' are parallel to one another and to the optical axis 233, their distance from one another being vanishingly small.

An optical deflection element in the form of two wedge-shaped prisms 261 and 261' is disposed behind each of the openings 225 and 225', respectively. Prisms 261 and 261' are arranged so that their deflection axes each enclose an acute angle with the optical axis 233. In the direction of these deflection axes, behind each of the prisms 261 and 261', there are positioned field lenses 228 and 228', respectively, followed by light-sensitive detectors 224 and 224', respectively. A mask pivot drive 259, which includes a stepping motor 260, engages the common mask 223 and pivots it as the battle tank 20 tilts. Otherwise, the receivers 218 and 218' have the same components as the same arrangement described in connection with FIG. 6 and operate in the same manner.

Figure 9:
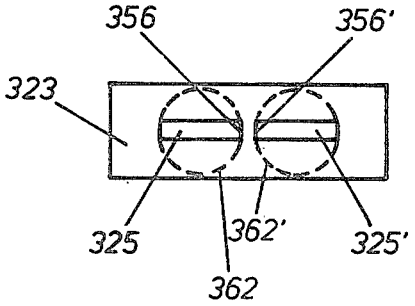
FIG. 9 is a sectional view along the line IX—IX of FIG. 8.

The receivers 318 and 318' of FIG. 8, which are enclosed in a common housing 357, are substantially identical to the receivers of FIG. 7. The only difference is that, instead of prisms and field lenses, conical photo conductors 362 and 362' are disposed behind each of the openings 325 and 325' in the aperture masks 323. Light sensitive detectors 324 and 324', are located directly at the light exit opening 363 and 363', respectively of the respective photoconductors 362 and 362'. A top view of the mask 323 and photoconductors 362 and 362' is shown in FIG. 9.

The embodiments of the invention employing receivers 218, 218' and 318, 318' of FIGS. 7 and 8 respectively, provide a higher light yield and therefore higher reception sensitivity than the embodiment employing receivers 118 and 118' of FIG. 6. In the embodiment of FIG. 8, it is possible to completely eliminate the aperture mask 323 if the light entrance openings of the two photoconductors 362 and 362' are shaped to correspond to the aperture openings 325 and 325'.

The present invention is not limited to the abovedescribedembodiments of a firing field limiting device. The light transmitters 17, 117 and 117' may also transmit in the ultraviolet or visible range and, in fact, are not limited to the optical field. It is also possible to use transmitters which emit radio signals.

The firing field limiting device according to the invention can also be used to control the firing range of a distance measuring laser provided in the battle tank 20. By limiting in elevation and azimuth the firing angle of the distance measuring laser coupled with the onboard cannon 15, the firing of the laser to deterine the distance between the weapon and the target is limited to only the target area thereby eliminating danger to persons outside the target area.

The activation signal generated by the firing field limiting device can simultaneously control in the same manner an unblocking device for a distance measuring laser so that the firing field limiting device can simultaneously confine the fired projectile and the laser beam to a given target area. For this mode of operation, the laser unblocking device 164 is connected to the output of the logic AND gate 154. (FIG. 6). The laser unblocking device 164 is identical to the fire unblocking device 116, the switch contact of the laser unblocking device being located in the laser release circuit (not shown) which is manually operated by the gunner.

Figure 10:
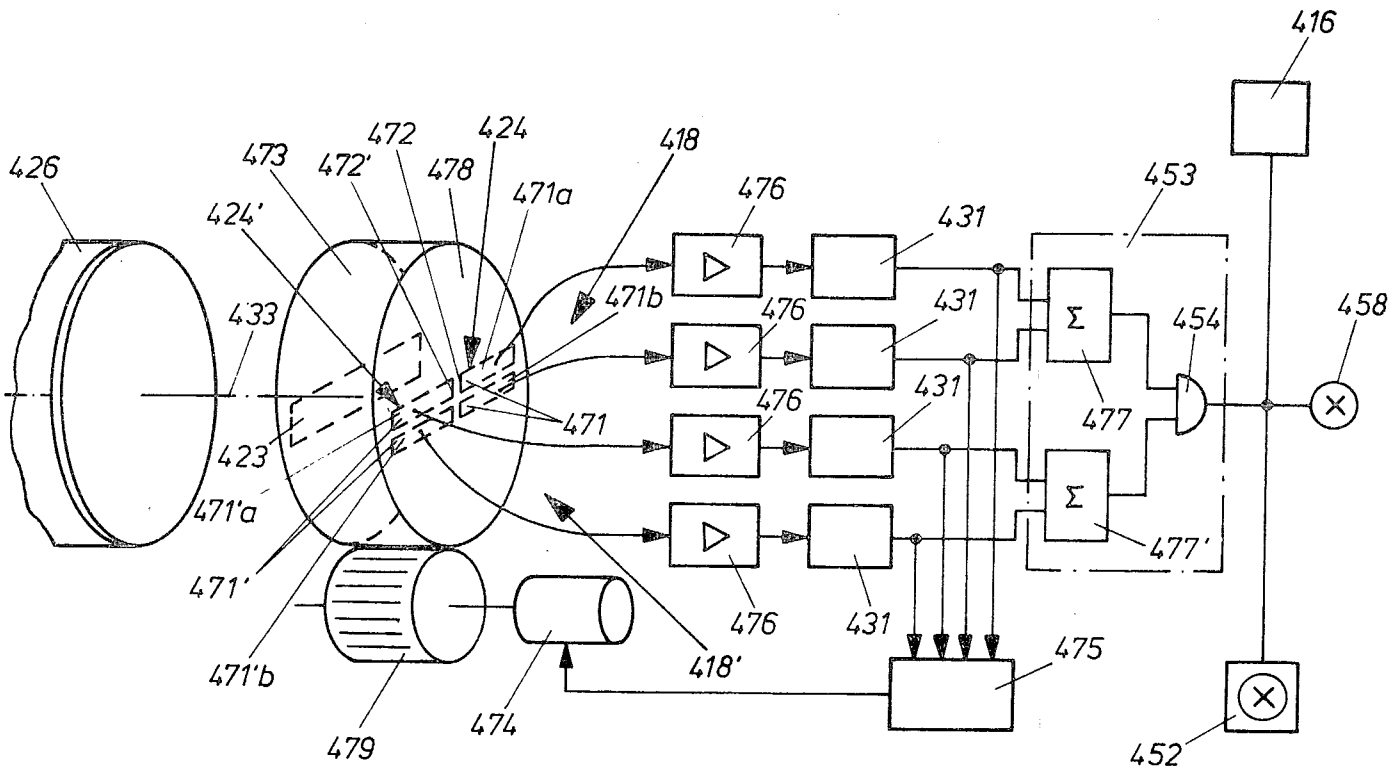
FIG. 10 is a block circuit diagram of a further modified embodiment of the receivers of FIG. 6.

FIG. 10 shows a further embodiment of the receivers for the firing field limiting device as already described in connection with FIG. 5. The two receivers, identified in FIG. 10 as 418 and 418' have a common objective 426 shown schematically in FIG. 10, and a common aperture 423. The aperture 423 is disposed in the focal point of the objective 426 and is arranged to be symmetrical, in the horizontal direction, with the optical axis 433 of the objective 426.

With the optical axis 433 as a reference, the aperture 423 defines an angle of 2.5° toward the top and an angle of 1° toward the bottom. The lateral azimuth boundaries measuring from the optical axis 433 are 30° to the left and 30° to the right. The aperture 423 thus delimits the opening angle of the receiving characteristics of the two receivers 418 and 418' at the top and bottom, i.e. in elevation and, at the sides facing away from one another, also with respect to the most remote marginal beams of the receiving characteristics.

In the direction of the impinging light behind the aperture 423, there are disposed two photosensitive detectors 424 and 424' in a common plane 478. The detectors 424 and 424' are arranged in a fixed alignment with the aperture 423 on a carrier 473 which is rotatable about the optical axis 433 and which is driven, via a gear connection 479, by a reversible rotation motor 474.

In the horizontal direction, the detection surfaces 471 and 471' of the two detectors 424 and 424' are symmetrical with respect to the optical axis 433 and each extend up to the axis 433. The facing vertical delimiting edges 472 and 472' of the detection surfaces 471 and 471' are spaced a short distance from each other and delimit the opening angle of the receiving characteristics of the two receivers 418 and 418' with respect to the facing marginal beams of the receiving characteristics essentially along the optical axis 433.

To exclude, as in the embodiment of FIG. 6, the effect of possible tilting of the combat tank 20 due to uneven terrain on the firing field limiting device, the detection surfaces 471 and 471' of the detectors 424 and 424' are each subdivided essentially horizontally into upper partial areas 471*a* and 471'*a* and lower partial areas 471*b* and 471'*b*. The outputs of the various partial detector areas 471*a*, 471*b*, 471'*a* and 471'*b* are each connected, via amplifiers 476 and decoders 431 in the form of bandpass filters, with a regulator 475, the output of the regulator 475 being connected to the motor 474. Regulator 475, which comprises two adders and a subtractor (not shown) connected to the outputs of the adders, keeps the motor 474 switched on as long as the condition $$[A(471'a)-A(471'b)]-[A(471a)-A(471b)]=0$$

is not met. A(471'*a*), A(471'*b*), A(471*a*) and A(471*b*) are the output signals of the partial detector surfaces 471'*a*, 471'*b*, 471*a* and 471*b* respectively. The motor 474 rotates the carrier 473, via the gear connection 479, until the above condition is met, i.e. quality exists between the difference between the output signals of the partial detector surfaces 471*a*, 471*b* on the one hand and 471'*a*, 471'*b* on the other hand. When no control signal appears at the output of the regulator, the motor 474 is stopped. Thus, if the combat tank 20 is slightly tilted to the side, the receivers rigidly mounted on the weapons aperture of the tank will also be tilted. For example, for a tilt to the right, the partial detector surfaces 471*a* and 471*b* pivot upwardly, and the signals from transmitters 117 associated with receivers 418, 418' are no longer received at the same height on both partial areas 471*a* and 471'*b* and/or 471*b* and 471'*b*. In this case, the output signal of the partial detector surface 471*b* will be greater than the output signal o the partial detector surface 471*a* and/or the output signal of the partial detector surface 471'*a* will be greater than the output signal of the partial detector surface 471'*b*.

The control signal appearing at the output of the regulator 475 switches on the motor 474 which rotates the carrier 473 to the extent that the partial detector surfaces 471*a*, 471*b* and 471'*a*, 471'*b* again lie approximately in the horizontal plane. The horizontal plane is reached when the signals from transmitters 117 associated with the receivers 418, 418' are again received at the same height on the two partial detector surfaces 471*a* and 471'*a* and/or 471*b* and 471'*b*, i.e. the difference of the output signals of the partial detector surfaces 471*a*, 471*b* on the one hand and 471'*a*, 471'*b* on the other hand is the same.

The outputs of the decoders 431 are connected to an electronic evaluation system 453 which, similar to the embodiment of FIG. 6, controls the fire unblocked display 458, the fire blocked display 452 and the fire unblocking device 416. The electronic evaluation system 453 is provided with a logic AND gate 454 having an output connected to devices 416, 452 and 458. The electronic evaluation system 453 further includes two summing members 477 and 477' whose inputs are connected to the outputs of the decoders 431. The outputs of the decoders 431 of the receiver 418, connected with the partial detector surfaces 471*a* or 471*b* are connected to the summing member 477 and the outputs of the decoders 431 associated with the receiver 418' are connected to the summing member 477'. The outputs of the two summing members 477 and 477', which form the signal outputs of the two receivers 418, 418', are connected to the inputs of the logic AND gate 454.

The operation of receivers 418 and 418' differs from that of the receivers 118 and 118' shown in FIG. 6 only with respect to the compensation for tilting of the combat tank 20. Otherwise they both operate the same so that reference is made to that description.

It will be understood that the above description of the present invention is susceptible to various modifications, changes and adaptations, and the same are intended to be comprehended within the meaning and range of equivalents of the appended claims.

What is claimed is:

1. Apparatus for limiting the firing field of a tubular weapon to a predetermined target area bounded by first and second longitudinal sides extending approximately in the direction of firing, said weapon having a barrel and being movable within a given firing area, comprising first and second spaced stationary transmitters positioned adjacent the first and second longitudinal sides respectively of said target area at locations remote from said weapon in the direction of firing;

a receiving device rigidly attached to said weapon, said receiving device including first and second spaced directional receivers positioned next to one another in a horizontal plane for receiving signals from said first and second transmitters respectively, the adjacent edges of the directional patterns of said receivers extending in planes parallel to and on either side of a vertical plane passing through the bore axis of the barrel of said weapon;

an AND gate having first and second inputs coupled to the outputs of said first and second directional receivers respectively; and a fire unblocking device coupled to the output of said AND gate and to said weapon, said fire unblocking device being actuated to permit firing of said weapon only when said receiving device receives simultaneously signals transmitted by both said first and second transmitters thereby indicating that the barrel of said weapon is aimed toward said target area.

2. Apparatus as defined in claim 1, wherein said first and second stationary transmitters are optical transmitters, each of said optical transmitters emitting light radiation.

3. Apparatus as defined in claim 2, wherein said optical transmitters emit infrared radiation.

4. Apparatus as defined in claim 2, wherein each of said directional receivers comprises a light-sensitive detector, an optical mask adjacent thereto positioned along an optical axis, said mask having an aperture therein for selectively allowing radiation emitted by said optical transmitters to impinge on said detectors, and a field lens interposed between said aperture mask and said detector, the aperture angle of each of said receivers being determined by the aperture in its optical mask; and wherein said apparatus further comprises an objective lens for transmitting radiation to said light sensitive detectors through the apertures in said optical masks, and a special filter for transmitting light to said objective lens, said special filter having characteristics matched to the transmitting spectrum and spectral sensitivity of said light-sensitive detectors.

5. Apparatus as defined in claim 1 wherein each of said transmitters comprises a light source, a reflector adjacent one side of said light source, a light radiating window covered with a filter for permitting only infrared radiation to pass therethrough, and an objective lens interposed between said window and said light source.

6. Apparatus as defined in claim 5 which further comprises a pair of rotatable slotted discs, one of said discs being positioned on one side of said light source and the other disc on the other side of said light source for providing light/dark coding of said transmitted signal.

7. Apparatus as defined in claim 1 wherein the aperture angles of both directional receivers correspond in elevation to the predetermined permissible elevation angle of the barrel of said weapon with respect to a horizontal plane.

8. Apparatus as defined in claim 1 wherein said first and second receivers comprise first and second light-sensitive detectors and first and second optical masks respectively, said masks having apertures therein each with a vertical delimiting edge, said apparatus further comprising an objective lens common to said first and second receivers and a common beam divider interposed between said common objective lens and said first and second optical masks, the apertures in the optical masks of said first and second receivers being disposed in first and second image planes alternately symmetrical with the optical axis of said objective lens, the vertical delimiting edge of each of said apertures intersecting the optical axis of said objective.

9. Apparatus as defined in claim 1 wherein said first and second receivers comprise first and second light-sensitive detectors respectively, said apparatus further comprising an objective lens and an optical mask both common to said first and second receivers positioned along a common optical axis, said mask having first and second apertures therein, each including a vertical delimiting edge extending parallel to said common optical axis, the distance between said delimiting edges approaching zero.

10. Apparatus as defined in claim 9 which further comprises an optical deflection element positioned adjacent the first and second apertures in said optical mask between said mask and said first and second light-sensitive detectors, the deflection axis of said optical deflection element forming an acute angle with said common optical axis; and wherein first and second field lenses are interposed between said optical deflection element and said first and second light-sensitive detectors, light being transmitted through said objective lens, optical mask, optical deflection element and first and second field lenses to said first and second light-sensitive detectors.

11. Apparatus as defined in claim 9 which further comprises first and second conical photoconductors interposed between the first and second apertures in said optical mask and said first and second light-sensitive detectors respectively.

12. Apparatus as defined in claim 8, 9, 10 or 11 wherein means are provided for pivoting said optical mask about said optical axis; and drive means connected to the outputs of said first and second light-sensitive detectors and to said pivoting means, said drive means automatically compensating for any difference between the angle of said optical mask and the horizontal by driving said pivoting means.

13. Apparatus as defined in claim 1 wherein said first and second receivers have a common objective and a common aperture, said common objective and common aperture delimiting the aperture angles of said receiver pattern in elevation and with respect to the marginal beams of said receiver pattern that face away from one another; said apparatus further comprising photosensitive detectors having closely spaced vertical delimiting edges arranged in a common plane symmetrical with the optical axis of said objective, the vertical delimiting edges of said detection surfaces extending to said optical axis.

14. Apparatus as defined in claim 13 which further comprises a carrier mounted for rotation about said optical axis, said aperture and photosensitive detectors being located on said carrier in rigid alignment with each other; and a reversible motor coupled to said carrier for rotation thereof about said optical axis.

15. Apparatus as defined in claim 14 wherein the surface of each of said photosensitive detectors is divided into upper and lower substantially horizontal partial areas, and wherein said apparatus further comprises a plurality of amplifiers each having its input coupled to a corresponding partial area of one of said photosensitive detectors; a plurality of decoders each having its input coupled to the output of an associated amplifier; and a regulator having its input coupled to the outputs of said decoders and its output coupled to said reversible motor, said regulator energizing said motor when the signals generated at said partial areas are unequal and deenergizing said motor when said signals are equal.

16. Apparatus as defined in claim 15 which further comprises a summing member coupled to the outputs of two of said plurality of decoders to generate a receiver signal output, said two decoders being coupled through two of said amplifiers to the upper and lower partial areas of one of said photosensitive detectors.

17. Apparatus as defined in claim 14 wherein the surface of each of said photosensitive detectors is divided into upper and lower substantially horizontal partial areas, and wherein said apparatus further comprises a plurality of amplifiers each having its input coupled to a corresponding partial area of one of said photosensitive detectors; a plurality of decoders each having its input coupled to the output of an associated amplifier; and a summing member coupled to the outputs of two of said plurality of decoders to generate a receiver signal output, said decoders being coupled through two of said amplifiers to the upper and lower partial areas of one of said photosensitive detectors.

* * * * *